US008733274B2

(12) United States Patent
Otis, Jr. et al.

(10) Patent No.: US 8,733,274 B2
(45) Date of Patent: May 27, 2014

(54) TUBE MOUNTED INKJET PRINTHEAD DIE

(75) Inventors: David R. Otis, Jr., Corvallis, OR (US); Jeffrey A. Nielsen, Corvallis, OR (US); Casey T. Miller, Corvallis, OR (US); Gerald F. Meehan, Corvallis, OR (US); Isaac Farr, Corvallis, OR (US); Joseph W. Dody, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1986 days.

(21) Appl. No.: 11/551,318

(22) Filed: Oct. 20, 2006

(65) Prior Publication Data

US 2008/0094428 A1 Apr. 24, 2008

(51) Int. Cl.

| | |
|---|---|
| ***B05B 7/06*** | (2006.01) |
| ***B05C 11/00*** | (2006.01) |
| ***B41J 29/38*** | (2006.01) |
| ***B41J 2/045*** | (2006.01) |
| ***B41J 2/41*** | (2006.01) |
| *B05D 1/02* | (2006.01) |
| *C23C 28/00* | (2006.01) |

(52) U.S. Cl.

USPC ..... 118/316; 118/313; 118/663; 118/315; 118/DIG. 10; 427/427.2; 347/13; 347/40; 347/42; 347/68; 347/152; 623/1.1; 623/1.54; 623/23.7; 623/23.76

(58) Field of Classification Search

CPC .... B05C 5/0291; B05C 11/1005; B05B 7/08; B05B 13/0278

USPC ..... 118/408, 663, 313; 347/1, 40, 47, 70, 347/68, 106, 13, 42; 700/119; 427/427.2

See application file for complete search history.

(56) References Cited

U.S. PATENT DOCUMENTS

| | | | | | |
|---|---|---|---|---|---|
| 1,162,717 | A | * | 11/1915 | White | 118/316 |
| 1,835,402 | A | * | 12/1931 | Juers | 118/323 |
| 3,439,649 | A | * | 4/1969 | Zupan et al. | 118/634 |
| 3,598,044 | A | * | 8/1971 | Hutchinson | 101/46 |
| 3,771,968 | A | * | 11/1973 | Stalnaker | 422/275 |
| 3,835,975 | A | * | 9/1974 | Howard | 400/124.17 |
| 3,907,092 | A | * | 9/1975 | Kwan et al. | 400/124.24 |
| 3,991,871 | A | * | 11/1976 | McIntosh, Sr. | 400/124.26 |
| 4,069,084 | A | | 1/1978 | Miodozeniec et al. | |
| 4,086,997 | A | * | 5/1978 | Wu | 400/57 |
| 4,197,289 | A | | 4/1980 | Sturzenegger et al. | |
| 4,308,546 | A | * | 12/1981 | Halasz | 347/68 |
| 4,322,449 | A | | 3/1982 | Voss et al. | |
| 4,349,529 | A | | 9/1982 | Morcos et al. | |
| 4,364,067 | A | * | 12/1982 | Koto et al. | 347/70 |
| 4,415,909 | A | * | 11/1983 | Italiano et al. | 347/68 |
| 4,463,362 | A | * | 7/1984 | Thomas | 347/86 |
| 4,493,137 | A | * | 1/1985 | Bader et al. | 29/25.35 |
| 4,548,825 | A | | 10/1985 | Voss et al. | |
| 4,623,904 | A | * | 11/1986 | Conta et al. | 347/68 |
| 4,628,332 | A | * | 12/1986 | Matsumoto | 347/49 |
| 4,689,641 | A | * | 8/1987 | Scardovi et al. | 347/68 |
| 4,877,745 | A | * | 10/1989 | Hayes et al. | 436/166 |
| 4,905,589 | A | | 3/1990 | Ackley | |
| 4,998,972 | A | | 3/1991 | Chin et al. | |
| 5,352,292 | A | * | 10/1994 | Thomas | 118/669 |
| 5,372,585 | A | * | 12/1994 | Tiefenbrun et al. | 604/59 |
| 5,402,351 | A | * | 3/1995 | Batchelder et al. | 700/119 |

(Continued)

*Primary Examiner* — Yewebdar Tadesse
*Assistant Examiner* — Karl Kurple

(57) ABSTRACT

Inkjet print head dies are directly seated upon an exterior of a tubular member so as to face different directions.

24 Claims, 5 Drawing Sheets

(56) References Cited

U.S. PATENT DOCUMENTS

| | | | | |
|---|---|---|---|---|
| 5,501,535 | A * | 3/1996 | Hastings et al. | 400/88 |
| 5,607,364 | A * | 3/1997 | Hedrick et al. | 473/318 |
| 5,609,908 | A | 3/1997 | Voss | |
| 5,714,007 | A | 2/1998 | Pletcher et al. | |
| 5,881,716 | A | 3/1999 | Wirch et al. | |
| 5,895,375 | A * | 4/1999 | Wilcox et al. | 604/175 |
| 5,901,425 | A * | 5/1999 | Bibl et al. | 29/25.35 |
| 5,925,732 | A | 7/1999 | Ecker et al. | |
| 5,969,971 | A * | 10/1999 | Brown et al. | 700/119 |
| 6,059,749 | A * | 5/2000 | Marx | 604/82 |
| 6,086,942 | A | 7/2000 | Carden, Jr. et al. | |
| 6,107,004 | A | 8/2000 | Donadio | |
| 6,143,353 | A | 11/2000 | Oshlack et al. | |
| 6,309,375 | B1 | 10/2001 | Glines et al. | |
| 6,395,326 | B1 * | 5/2002 | Castro et al. | 427/2.24 |
| 6,443,146 | B1 * | 9/2002 | Voges | 128/200.14 |
| 6,481,836 | B1 * | 11/2002 | Paroff et al. | 347/85 |
| 6,523,921 | B2 * | 2/2003 | Codos | 347/8 |
| 6,547,788 | B1 * | 4/2003 | Maguire et al. | 606/41 |
| 6,585,341 | B1 * | 7/2003 | Walker et al. | 347/14 |
| 6,645,547 | B1 | 11/2003 | Shekalim et al. | |
| 6,659,996 | B1 * | 12/2003 | Kaldany | 604/508 |
| 6,713,389 | B2 | 3/2004 | Speakman | |
| 6,786,591 | B2 * | 9/2004 | Dunfield et al. | 347/106 |
| 6,902,256 | B2 * | 6/2005 | Anderson et al. | 347/56 |
| 7,014,289 | B1 * | 3/2006 | Matsuda | 347/19 |
| 7,044,575 | B2 * | 5/2006 | Kelley et al. | 347/19 |
| 7,406,361 | B2 * | 7/2008 | Ohmori et al. | 700/119 |
| 7,434,902 | B2 * | 10/2008 | Baker et al. | 347/8 |
| 7,597,764 | B2 * | 10/2009 | Verlee et al. | 118/667 |
| 7,701,478 | B2 * | 4/2010 | Murcia et al. | 347/198 |
| 7,767,130 | B2 * | 8/2010 | Elsner et al. | 264/308 |
| 7,857,756 | B2 * | 12/2010 | Warren et al. | 600/159 |
| 8,303,285 | B2 * | 11/2012 | Bradley | 425/13 |
| 2001/0016177 | A1 | 8/2001 | Pelc et al. | |
| 2003/0113459 | A1 * | 6/2003 | Hammond et al. | 427/372.2 |
| 2004/0021746 | A1 * | 2/2004 | Sole et al. | 347/85 |
| 2004/0089329 | A1 * | 5/2004 | Bijster | 239/227 |
| 2004/0230176 | A1 | 11/2004 | Shanahan et al. | |
| 2004/0253365 | A1 | 12/2004 | Warren et al. | |
| 2005/0011652 | A1 * | 1/2005 | Hua | 169/37 |
| 2005/0248633 | A1 * | 11/2005 | DeFosse et al. | 347/85 |
| 2006/0020167 | A1 * | 1/2006 | Sitzmann | 600/173 |
| 2006/0031099 | A1 | 2/2006 | Vitello et al. | |
| 2006/0068095 | A1 * | 3/2006 | Nishi et al. | 427/240 |
| 2006/0127153 | A1 * | 6/2006 | Menchik et al. | 400/62 |
| 2006/0233614 | A1 * | 10/2006 | LaFreniere et al. | 405/128.75 |
| 2009/0277385 | A1 * | 11/2009 | Case et al. | 118/696 |
| 2010/0119722 | A1 * | 5/2010 | Tarozzi | 427/424 |
| 2010/0221449 | A1 * | 9/2010 | Schlatterbeck et al. | 427/558 |
| 2010/0326352 | A1 * | 12/2010 | Hart et al. | 118/317 |
| 2011/0146570 | A1 * | 6/2011 | Bradley | 118/641 |

* cited by examiner

TUBE MOUNTED INKJET PRINTHEAD DIE

BACKGROUND

Selectively coating interior surfaces of three-dimensional structures or bodily organs may be difficult and imprecise. Moreover, existing fluid dispensing devices for coating such interior surfaces may be too large, too complex and too inversatile.

DETAILED DESCRIPTION OF THE EXAMPLE EMBODIMENTS

Figure 1:
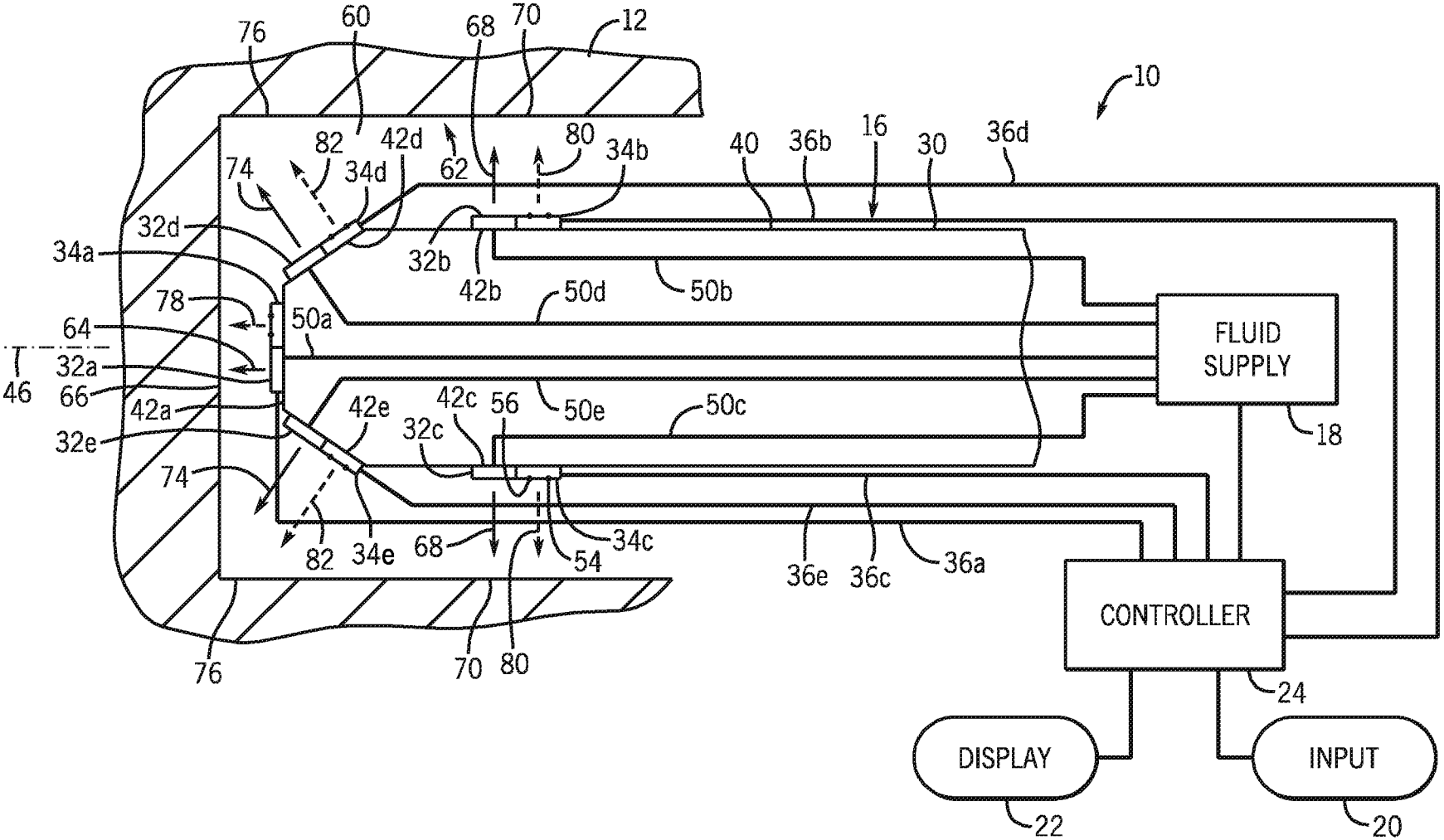
FIG. 1 is a schematic illustration of a fluid dispensing system dispensing fluid onto interior surfaces according to one example embodiment.

FIG. 1 schematically illustrates fluid ejecting or dispensing system 10 configured to selectively dispense fluid onto interior surfaces of three-dimensional structures, such as structure 12. In one embodiment, structure 12 may comprise a structure configured to be implanted with a living human or animal body, such as a stent. System 10 is well suited for depositing fluid onto interior surfaces of such relatively small structures. System 10 generally includes fluid dispenser 16, fluid supply 18, input 20, display 22 and controller 24. Fluid dispenser 16 comprises a device configured to selectively eject fluid towards one or more selected interior surfaces of structure 12. Fluid dispenser 16 includes probe 30, inkjet printhead dies 32*a*, 32*b*, 32*c*, 32*d* and 32*e* (collectively referred to as dies 32), sensing devices 34*a*, 34*b*, 34*c*, 34*d* and 34*e* (collectively referred to as devices 34) and signal and power transmitting interconnect lines 36*a*, 36*b*, 36*c*, 36*d* and 36*e* (collectively referred to as lines 36).

Probe 30 comprises an elongated tubular member configured to support dies 32, devices 34 and lines 36. In the particular example illustrated, probe 30 includes an exterior 40 configured to support dies 32, devices 34 and lines 36. Because probe 30 supports dies 32, devices 34 and lines 36 on exterior 40, probe 30 may be fabricated at a lower cost. In addition, repair or replacement of such components may be more easily completed and modification of probe 30 to meet varying needs is facilitated. In one embodiment, probe 30 comprises a tube having a circular cross-section. In other embodiments, probe 30 may comprise a tube having other non-circular cross-sectional shapes, such as an oval cross-section or a polygonal cross-section (triangular, square, rectangular, decagonal, hexagonal and so on).

In the particular example illustrated, exterior 40 includes a plurality of the facets 42*a*, 42*b*, 42*c*, 42*d* and 42*e* (collectively referred to as facets 42). Facets 42 comprise generally flat, planar portions along exterior 40 upon which dies 32 and devices 34 may be mounted. Facets 42 facilitate reliable positioning of dies 32 and devices 34 at desired orientations with respect to axial centerline 46 of probe 30. In the example embodiment illustrated, facet 42*a* extends generally perpendicular to axial centerline 46 so as to face in a direction parallel to axial centerline 46. Facets 42*b* and 42*c* extend substantially parallel to axial centerline 46 so as to radially face away from axial centerline 46. Facet 42*d* and facet 42*e* are angled with respect to axial centerline 46 so as to face in directions oblique to axial centerline 46. In the example illustrated, facets 42*d* and 42*e* extend in non-parallel planes proximate an end or tip of probe 30. In the example illustrated, facets 42*d* and 42*e* are angled at approximately 45 degrees with respect to axial centerline 46. In other embodiments, facets 42*d* and 42*e* may extend at other oblique angles with respect to axial centerline 46. In other embodiments, probe 30 may omit facets 42, wherein dies 32 and devices 34 are mounted to portions of exterior 40 which are not flat or planar. In yet other embodiments, dies 32 and devices 34 may alternatively be molded within or connected to probe 30 so as to not be located upon exterior 40.

As further shown by FIG. 1, probe 30 provides fluid passages or lumens 50*a*, 50*b*, 50*c*, 50*d* and 50*e* (collectively referred to as lumens 50). Lumens 50 are configured to deliver fluid from fluid supply 18 to dies 32. In particular, lumens 50*a*, 50*b*, 50*c*, 50*d* and 50*e* deliver fluid to dies 32*a*, 32*b*, 32*c*, 32*d* and 32*e*, respectively. Although schematically illustrated as substantially linear, in other embodiments, such lumens 50 may have irregular or circuitous paths. Although probe 30 is illustrated as including a dedicated lumen 50 for each of dies 32, in other embodiments, probe 30 may include fewer lumens 50, wherein two or more of dies 32 receive fluid via a shared lumen 50.

Inkjet printhead dies 32 comprise packages of components arranged to form a mountable printhead including one or more individual and selectively actuatable fluid ejectors which eject fluid through a plurality of nozzles. According to one embodiment, such printhead dies 32 may comprise a drop-on-demand ejector or device. According to one embodiment, printhead dies 32 comprise thermoresistive inkjet print heads or drop-on-demand devices in which heat produced by transmitting electrical current through resistors vaporizes fluid in a chamber behind a nozzle to expel remaining fluid through the nozzle. As a result, the print heads of dies 32 have greater spatial efficiency, allowing smaller geometries, and have a reduced sensitivity to gas bubbles in the system as compared to other drop-on-demand ejection devices such as piezo and acoustic ejection devices. In other embodiments, dies 32 may alternatively include other drop-on-demand ejection devices such as piezo and acoustic devices.

As shown by FIG. 1, die 32*a* is mounted to exterior 40 along facet 42*a* and faces in a direction substantially parallel to axial centerline 46. Die 32*b* and die 32*c* are mounted to exterior 40 along facets 42*a* and 42*c*, respectively, to face in a direction perpendicular to axial centerline 46 radially outward from axial centerline 46. Die 32*d* and die 32*e* are mounted to exterior 40 along facets 42*d* and 42*e*, respectively, so as to face in directions oblique to axial centerline 46. As will be described in more detail hereafter, because dies 32*d* and 32*e* face in directions oblique to axial centerline 46, such dies facilitate the deposition of fluid upon surfaces that are also oblique to axial centerline 46, such as interior corners. As a result, may more effectively dispense fluid to a wider range of interior surfaces.

Sensing devices 34 comprise devices configured to sense or detect interior surfaces of the structures, such a structure 12, to facilitate viewing of the interior of structure 12 and to also provide feedback regarding the application of fluids to interior surfaces of structure 12. Sensing devices 34 provide signals to controller 24, enabling controller 24 to provide visual images of the interior of structure 12 as well as areas upon which fluids have been deposited with display 22. In one embodiment, sensing devices further provide or project electromagnetic radiation, such as visible light, towards the interior surfaces of structure 12 to enhance viewing of the interior of structure 12. In one embodiment, comprises an optical sensor, wherein each sensing device 34 includes a light emitter 54 and a light detector 56. In one embodiment, light emitter 54 comprises one or more light emitting diodes while light detector 56 comprises a camera including one of a charge-coupled device (CCD) sensor, a complementary metal oxide semiconductor (CMOS) sensor, or a contact image sensor (CIS). In other embodiments an emitter 54 and a detector 56 may comprise other devices. For example, sensing devices 34 may also comprise infra red or ultra-violet emitting and detecting sensing devices or MEMS contact cantilevers (profilometers) In other embodiments, emitter 54 may be omitted or both emitter 54 and detector 56 may be omitted.

In the particular example illustrated, sensing devices 34 are mounted to exterior 40 of probe 30. As a result, devices 34 may be more easily assembled and fabricated as part of probe 30. Moreover, sensing devices 34 may be more easily removed for repair or replacement or may be more easily selectively added to better meet varying needs of an application.

In the example illustrated, devices 34 are mounted to and share the same facets 42 as dies 32. As a result, space along exterior 40 of fluid dispenser 16 is conserved and sensing devices 34 may be better able to sense (such as focusing or capturing images) of those areas of structure 12 coated upon by dies 32. Moreover, because devices 34 share a facet 42 with an associated die 32, devices 34 may also be better able to share a common interconnect line 36 without occupying a large area of exterior 40. In other embodiments, devices 34 the alternatively be mounted to exterior 40 at other distinct locations. In yet other embodiments, devices 34 may be molded partially within or joined to probe 30 in other manners.

Interconnect lines 36 comprise electrically conductive lines configured to transmit one or both of control signals and electrical power for the operation of dies 32 and sensing devices 34. In one embodiment, interconnect lines 36 are provided by electrically conductive traces formed as part of a flexible circuit mounted to an exterior 40 of probe 30 and connected to controller 24 at one end while being connected to dies 32 and devices 34 at the other end. Because lines 36 are mounted or retained against exterior 40 of probe 30, rather than being integrally formed as part of probe 30, probe 30 is less complex and less expensive. In addition, interconnect lines 36 may be more easily repaired, modify and or replaced. In other embodiments, interconnect lines 36 may alternatively be integrally formed within or as part of probe 30, may extend within an interior probe 30 or may extend through lumens formed within probe 30. In lieu of comprising electrically conductive traces, line 36 may alternatively comprise wires. In particular embodiments, line 36 may alternatively be configured to transmit one of power and control signals, wherein other lines are used for transmitting control signals or for transmitting power. Lines 36 may also be configured to omit the transmission of power where power is supplied via a local power source proximate to die 32 and devices 34, such as a battery. In yet other embodiments, control signals may alternatively be transmitted wirelessly, such as with radio frequency signals.

Fluid supply 18 comprises a source of fluid to be selectively printed upon interior surfaces of structure 12. Fluid supply 18 is fluidly connected to each of dies 32 via lumens 50. Fluid supply 18 delivers such fluid to dies 32 in response to control signals from controller 24. In one embodiment, fluid supply 18 may include a fluid reservoir and a pump (not shown) for drawing fluid from the reservoir. In other embodiments, fluid supply 18 may comprise other devices for supplying fluid to dies 32. Examples of fluid that may be supplied by fluid supply 18 include, but are not limited to, inks, solutions containing electrically conductive, semi conductive or insulative solutes, medicinal or drug containing fluids (medicaments), adhesives or combinations thereof. For example, in one embodiment, fluid supply 18 may supply a fluid which forms a coating that slowly releases a drug or medicine over time.

Input 20 comprises one or more devices configured to facilitate the input of commands, instructions or selections from a person or other external device to controller 24. Input 20 enables a person, either manually or with another external electronic device, to direct controller 24 to selectively apply fluids to interior of structure 12. Input 20 may comprise a keyboard, a mouse, a microphone with appropriate voice recognition software or hardware, switches, buttons, slides and the like. Input 20 may also comprise an external port by which commands from an external electronic device may be supplied to controller 24.

Display 22 comprises a component configured to communicate information to a person either visually or audibly. In the example illustrated, display 22 is configured to present images provided by sensing devices 34 to a user. In one embodiment, display 22 comprises a monitor or screen which generates visible images in response to control signals from controller 24 which are based upon signals received from sensing devices 34. Display 22 enables a user to visually ascertain those interior surfaces of structure 12 that should or should not be coated, to determine the current positioning of probe 30 and dies 32 within structure 12 and to adjust the positioning as needed, and to review the performance of system 10 or to diagnose issues with respect to the performance of system 10.

Controller 24 comprises one or more processing units configured to generate control signals for directing the operation of fluid supply 18, sensing devices 34, display 22 and dies 32. In one embodiment, controller 24 is further configured to analyze feedback signals from dies 32 and devices 34 and to make adjustments based upon coating instructions or objectives received via input 20. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 24 is not limited to any specific combination of hardware circuitry and software, nor to any particular source for the instructions executed by the processing unit.

In operation, fluid dispenser 16 is inserted into interior 60 of structure 12. In one embodiment, fluid dispenser 16 may be precisely positioned within interior 60 using visual feedback provided sensing devices 34 and display 22. Controller 24 receives commands as to what portions of the interior surface of 62 of structure 12 are to be coated with fluid from fluid supply 18. In one embodiment, controller 24 may generate control signals causing display 22 to present an image of interior surface 62 to a user, wherein the user using a mouse or other input means highlights selected portions of the image displayed by display 22 to be coated with or, alternatively, not to be coated. The user may also input his instructions as to what particular fluids should be coated upon what particular interior surfaces 62 as well as the extent or thickness of the coating and the rate at which the coating is to be applied to one or more of interior surfaces 62. Based upon such instructions, controller 24 generates control signals directing fluid supply 18 to supply one or more different fluids to dies 32 via lumens 50. Controller 24 further generates control signals directing dies 32 to selectively eject the fluid onto interior surfaces 62 of structure 12. Controller 24 generation control signals also directing sensing devices 34 to detect the application of fluid to surfaces 62 and to transmit feedback signals to controller 24. Based on such feedback signals from sensing devices 34, controller 24 generates additional control signals directing display 22 to present a visual image to a user, allowing the user to visually ascertain what portions of interior surface 62 of structure 12 are being coated, to determine whether positioning of fluid dispenser 16 needs to be adjusted, to determine whether the fluid injection pattern of dies 32 needs to be adjusted or to determine whether system 10 is operating properly. In one embodiment, controller 24 may additionally analyze data from sensing devices 34 to compare actual results with intended results and to automatically make appropriate adjustments to a fluid ejection pattern and other fluid ejection control signals, such as fluid ejection rate, being transmitted to the inkjet nozzles of dies 32. Such inspection via the sensor assists in production process control and quality control.

As schematically shown by FIG. 1, controller 24 may generate control signals directing one or more fluids to be ejected and coated upon interior surface 62 of structure 12. In particular, controller 24 may generate control signals directing die 32*a* to eject a fluid in an axial direction as indicated by arrow 64 onto an opposite surface 66. Controller 24 may generate control signals directing one or both of dies 32*b* and 32*c* to eject a fluid in an radial direction as indicated by arrows 68 towards and onto side or circumferential surfaces 70. Controller 24 may generate control signals further directing one or both of dies 32*d* and 32*e* to eject a fluid at an angle oblique to axial centerline 46 as indicated by arrows 74 onto and into corners 76 of structure 12. As a result, system 10 is capable of coating substantially all interior surfaces 62 of structure 12.

At the same time, positioning of fluid dispenser 16 and the placement of ejected fluid has increased accuracy as a result of sensing devices 34. The ejection of fluid onto structure 12 by die 32*a* may be reviewed by sensing device 34*a* which has a sensing area or range (such as a viewing area of an optical sensor) generally centered about arrow 78. The ejection of fluid from dies 32*b* and 32*c* may be reviewed or verified by sensing devices 34*b* and 34*c*, respectively, which have viewing areas or ranges centered about arrows 80. Likewise, the ejection of fluid by dies 32*d* and 32*e* onto surfaces of corners 76 may be reviewed through the use of sensing devices 34*d* and 34*e*, respectively, which have sensing areas generally centered about arrows 82. As shown by FIG. 1, sensing devices 34*d* and 34*e* each have a sensing range having a centerline 82 oblique to the axial centerline 46 while dies 32*d* and 32*e* each face in a direction 74 parallel to the centerline 82 of the field of vision of sensing devices 34*d* and 34*e*.

FIGS. 2-5 illustrate fluid dispensing system 110, another embodiment of dispensing system 10 shown in FIG. 1. System 110 includes fluid dispenser 116 and fluid interconnect 117. System 110 further includes fluid supply 18, input 20, display 22 and controller 24, all of which are shown and described with respect to FIG. 1. Like system 10, fluid dispensing system 110 is configured to selectively eject and coat one or more fluids upon an interior surface.

Figure 2:
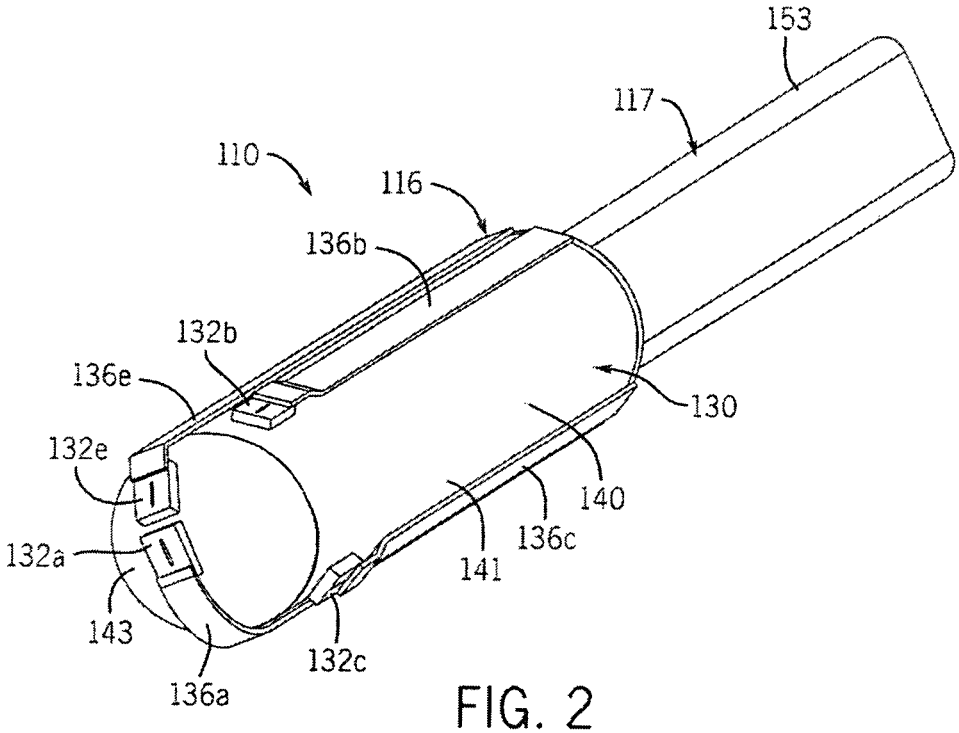
FIG. 2 is a top perspective view of another embodiment of the fluid dispensing system of FIG. 1 according to an example embodiment.
Figure 3:
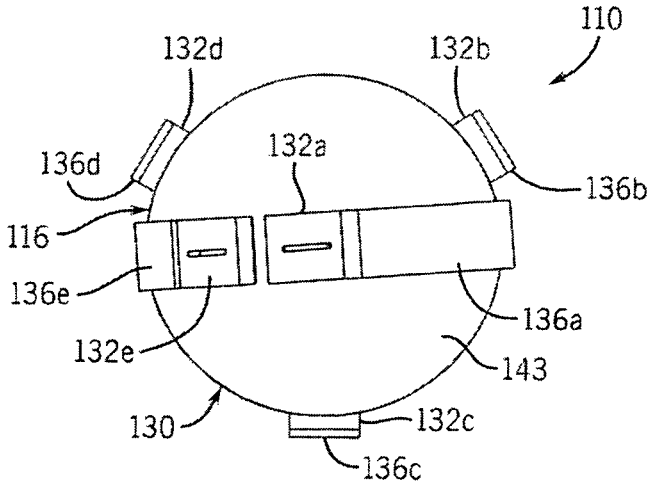
FIG. 3 is a left end elevational view of the fluid dispensing system of FIG. 2 according to an example embodiment.
Figure 4:
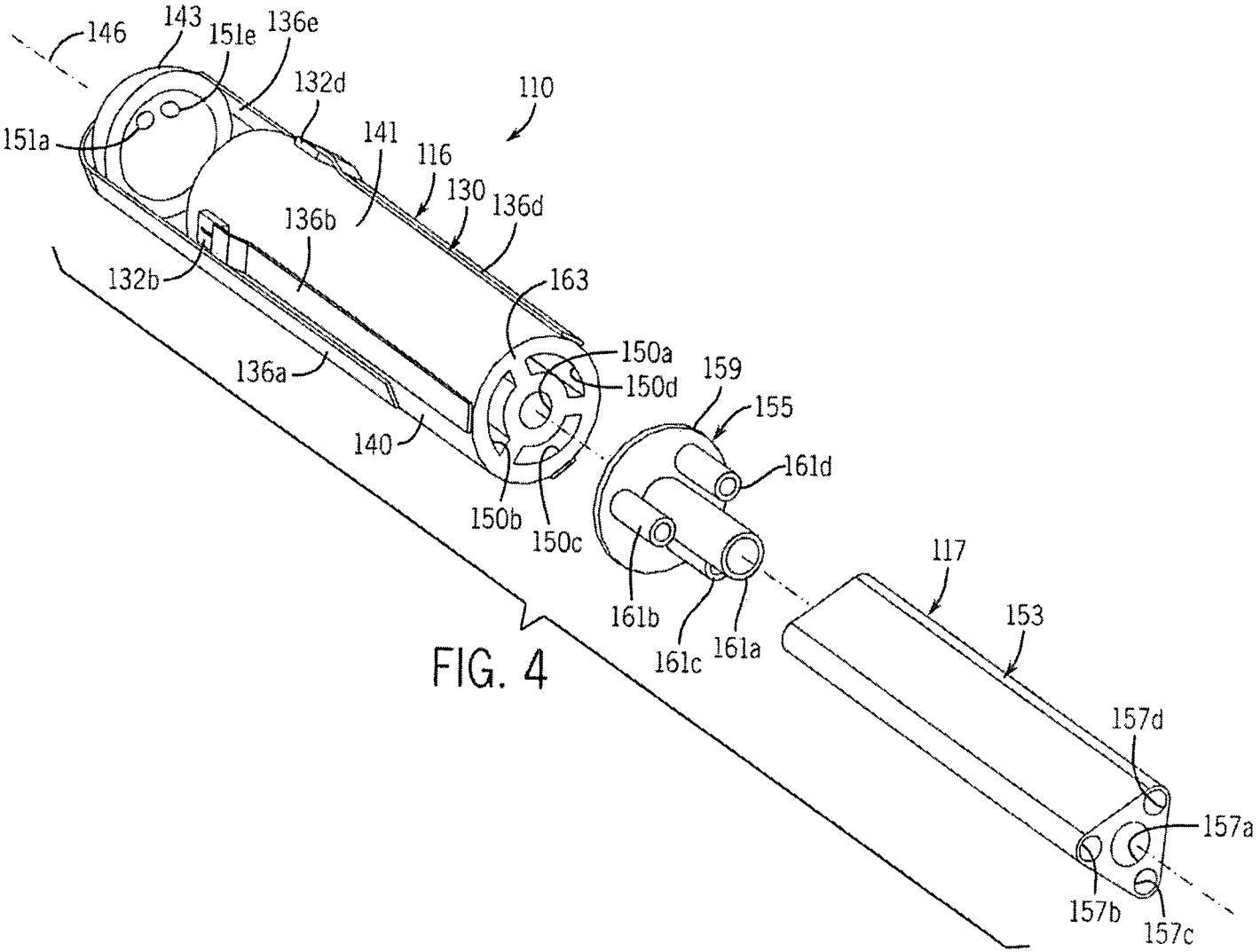
FIG. 4 is an exploded perspective view of the fluid dispensing system of FIG. 2 according to an example embodiment.

As shown by FIGS. 2-4 fluid dispenser 116 includes probe 130, dies 132*a*, 132*b*, 132*c*, 132*d* and 132*e* (collectively referred to as dies 132) and signal and/or power transmitting interconnect lines 136*a*, 136*b*, 136*c*, 136*d* and 136*e* (collectively referred to as lines 136). Probe 130 comprises an elongate tubular member configured to support dies 132 and lines 136. In the particular example illustrated, probe 130 includes an exterior 140 configured to support dies 132 and lines 1136. Because probe 130 supports dies 132 and lines 136 on exterior 140, probe 130 may be fabricated at a lower cost. In addition, repair or replacement of such components may be more easily completed and modification of probe 130 to meet varying needs is facilitated.

In the particular example illustrated in FIGS. 2-4, probe 130 includes an elongate tubular section 141 and an end section 143. Section 141 supports radially facing dies 132*b*, 132*c* and 132 *d*. Section 143 is coupled to section 141 and supports dies 132*a* and 132*e*. In the example illustrated, section 143 is hemispherical, bulbous, rounded or arcuate so as to provide probe 130 with a substantially cornerless tip to facilitate the insertion of probe 130 into other structures for coating the interior of other structures. In the example illustrated, section 143 is welded or adhered to section 141. In other embodiments, section 143 may be joined to section 141 with fasteners or with other connection methods. In other embodiments, section 143 may be integrally formed as part of a single unitary body with section 141.

As further shown by FIG. 4, probe 130 provides fluid passages or lumens 150*a*, 150*b*, 150*c* and 150*d* (collectively referred to as lumens 150) and openings 151*a* and 151*e* (collectively referred to as openings 151). Lumens 150 are configured to deliver fluid from fluid supply 18 (shown in FIG. 1) to dies 132. In particular, lumen 150*a* delivers fluid to dies 132*a* and 132*e* (shown in FIG. 2). Lumens 150*b*, 150*c* and 150*d* deliver fluid to dies 132*b*, 132*c*, and 132*d*, respectively. Because lumens 150 are provided by the walls or body of probe 130, probe 130 is less complex. In other embodiments, lumens 150 may alternatively be provided by additional tubes extending through one or more passages provided within probe 130. Although probe 130 is illustrated as including a dedicated lumen 150 for each of dies 132*b*, 132*c* and 132*d*, in other embodiments, probe 130 may include fewer lumens 150, wherein two or more of dies 132*b*, 132*c*, and 132*d* receive fluid via a shared lumen 150. In other embodiments, dies 132*a* and 132*e* may alternatively have separate dedicated lumens 150.

Openings 151*a* and 151*e* extend through section 143 and are configured to deliver fluid from lumen 150*a* to dies 132*a* and 132*e*, respectively. In other embodiments, openings 151 may alternatively be fluidly connected to other of lumens 150 or may be connected to distinct lumens 150.

Inkjet printhead dies 132 comprise packages of components arranged to form a mountable printhead including a plurality of individually and selectively actuatable fluid ejectors which eject fluid through a plurality of nozzles. According to one embodiment, printhead dies 132 comprise thermal resistive inkjet print heads in which heat produced by transmitting electrical current through resistors vaporizes fluid in a chamber behind a nozzle to expel remaining fluid through the nozzle. As a result, the print heads of dies 132 have greater spatial efficiency, allowing smaller geometries, and have a reduced sensitivity to gas bubbles in the system as compared to other drop-on-demand ejection devices such as piezo and acoustic ejection devices. In other embodiments, dies 132 may alternatively include other drop-on-demand ejection devices such as piezo and acoustic devices.

As shown by FIGS. 2 and 3, die 132*a* is mounted to exterior 140 along section 143 and faces in a direction substantially parallel to axial centerline 146. Die 132*b*, die 132*c* and die 132*d* are mounted to exterior 140 along section 141 to face in a direction perpendicular to axial centerline 146 radially outward from axial centerline 146. Die 132*e* is mounted to exterior 140 on section 143 so as to face in a direction oblique to axial centerline 146. Because die 132*e* faces in a direction oblique to axial centerline 146, die 132*e* facilitates the deposition of fluid upon surfaces that are also oblique to axial centerline 146, such as interior corners. As a result, may more effectively dispense fluid to a wider range of interior surfaces.

Interconnect lines 136 comprise one or more electrically conductive lines configured to transmit one or both of control signals and electrical power for the operation of dies 132. In the illustrated embodiment, interconnect lines 136 are provided by electrically conductive traces formed as part of a flexible circuit mounted to exterior 140 of probe 130 and connected to controller 24 (shown in FIG. 1) at one end while being connected to dies 132 at the other end. Interconnect lines 136 continuously extend along probe 130 and along fluid interconnect 117 to controller 24. However, for ease of illustration, illustration of lines 136 along interconnect 117 is omitted. Because lines 136 are mounted or retained against exterior 140 of probe 130, rather than being integrally formed as part of probe 130, probe 130 is less complex and less expensive. In addition, interconnect lines 136 may be more easily repaired, modified and or replaced. In other embodiments interconnect lines 136 may alternatively be integrally formed within or as part of probe 130, may extend within an interior of probe 130 or may extend through lumens formed within probe 130. In lieu of comprising electrically conductive traces, line 136 may alternatively comprise wires. Although lines 136 are illustrated as multiple distinct flex circuits, in other embodiments, lines 136 may alternatively be joined or combined in fewer flex circuits or a single flex circuit. In particular embodiments, lines 136 may alternatively be configured to transmit one of power and control signals, wherein other lines are used for transmitting control signals or for transmitting power. Interconnect lines 136 may also be configured to omit the transmission of power where power is supplied via a local power source proximate to die 132, such as a battery. In still other embodiments, interconnect lines 136 may also be configured to omit the transmission of control signals where such control signals are transmitted wirelessly such as through radio frequency signals.

Fluid interconnect 117 is configured to deliver fluid to fluid dispenser 116. As shown by FIG. 4, fluid interconnect 117 includes tube 153 and connector 155. Tube 153 is an elongate member including lumens 157*a*, 157*b*, 157*c* and 157*d* (collectively referred to as lumens 157). Lumens 157 comprise passages configured to deliver fluid to corresponding lumens 150 in probe 130. In the example illustrated, tube 153 is formed from one or more flexible materials having a sufficient flexibility such that tube 153 may bend or deform as fluid dispenser 116 is moved through non-linear paths. In other embodiments, tube 153 may be formed from more rigid materials.

Connector 155 connects to probe 130. In the example illustrated, connector 155 includes face 159 and tubular projections 161*a*, 161*b*, 161*c* and 161*d* (collectively referred to as projections 161). Face 159 is configured to abut against an opposite end or axial face 163 of probe 130 to facilitate a fluid tight connection between connector 155 and probe 130. In one embodiment, face 159 is bonded to face 163. In another embodiment, face 159 is welded to face 163. In yet other embodiments, face 159 may have other configurations or may be fastened to or integrally formed as part of a single unitary body with probe 130. In still other embodiments, connector 155 may include additional projections, similar to projections 161 which extend into lumens 150 to facilitate connection of connector 155 to probe 130.

Projections 161 extend from face 159 and correspond to lumens 157. Projections 161 are configured to be received within lumens 157 to assist in providing a fluid-tight seal therebetween. Each of projections 161 delivers fluid from corresponding lumens 157 to corresponding lumens 150. In other embodiments, connector 155 may be omitted, wherein tube 153 is connected directly to probe 130.

Figure 5:
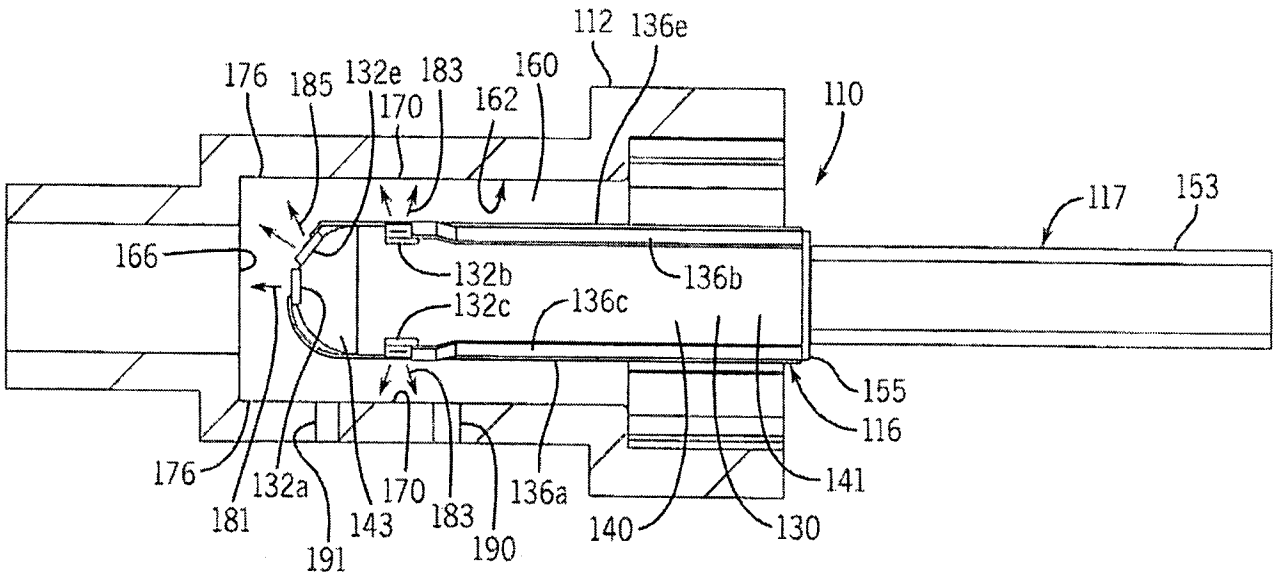
FIG. 5 is a side elevational view of the fluid dispensing system of FIG. 2 dispensing fluid onto interior surfaces of a structure shown in section according to an example embodiment.

FIG. 5 illustrates fluid dispensing system 110 positioned within interior 160 and delivering one or more fluids to interior surfaces 162 of a structure 112 (shown in section). As shown by FIG. 5, interior surfaces 162 of structure 112 (shown as a catheter) includes end surfaces 166, side surfaces 170 and intermediate angled or corner surfaces 176. As indicated by arrows 181, 183 and 185, fluid dispenser 116 may deliver fluid to each of the noted surfaces. In particular, die 132*a* may selectively deliver fluid to end surfaces 166 in a direction parallel to axial centerline 146 as indicated by arrow 181. Dies 132*b*, 132*c* and 132*d* (shown in FIG. 2) may selectively deliver fluid to side surfaces 170 as indicated by arrows 183. Die 132*e* may selectively deliver fluid to intermediate angled surfaces 176 as indicated by arrow 185.

Figure 6:
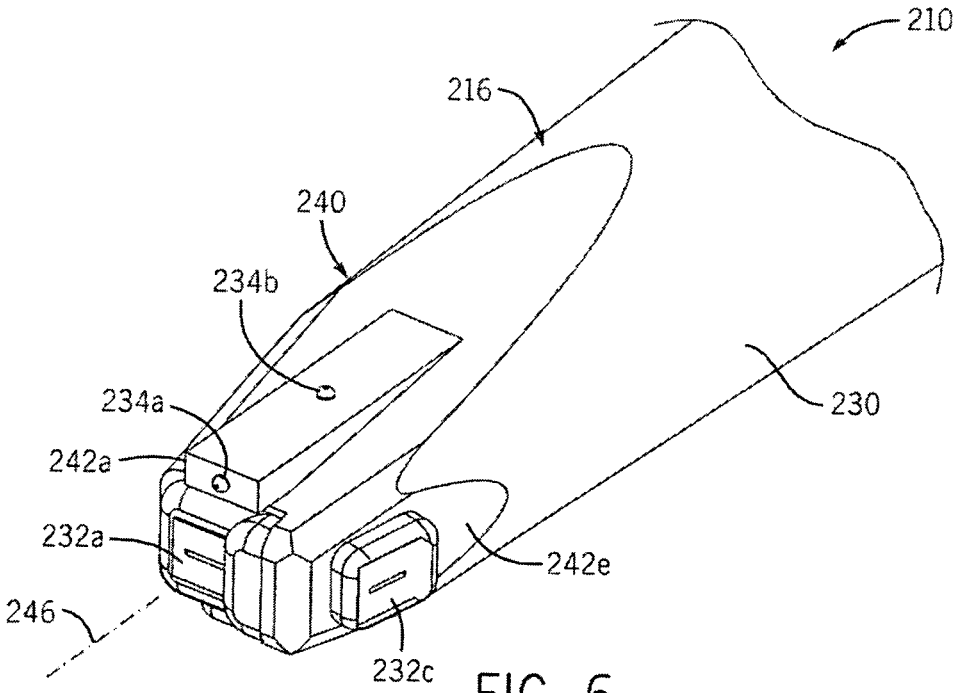
FIG. 6 is a fragmentary perspective view of another embodiment of the fluid dispensing system of FIG. 1 according to an example embodiment.
Figure 7:
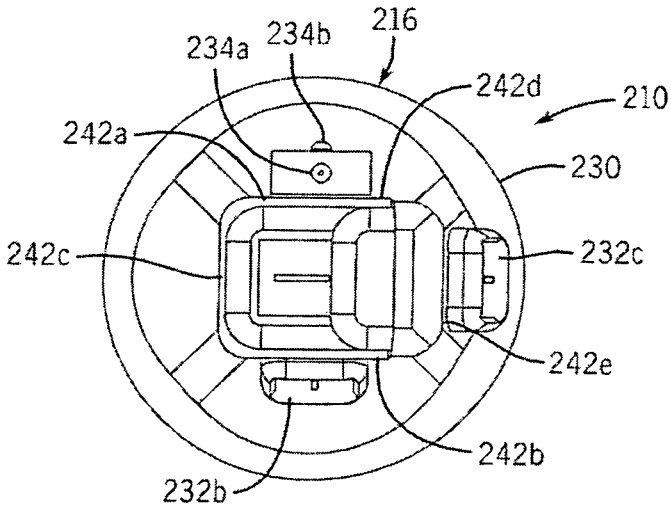
FIG. 7 is a left end elevational view of the fluid dispensing system of FIG. 6 according to an example embodiment.

FIGS. 6 and 7 illustrate fluid dispensing system 210, another embodiment of fluid dispensing system 10. Like systems 10 and 110, system 210 is configured to selectively deliver one or more fluids to coat interior surfaces. Like system 10, system 210 additionally provides visual feedback of the positioning of system 210 to enhance the accuracy at which fluid is ejected onto such interior surfaces. System 210 includes dispenser 216. System 210 additionally includes fluid supply 18, input 20, display 22 and controller 24, all of which are shown and described with respect to FIG. 1. Fluid dispenser 216 includes probe 230, ink jet dies 232*a*, 232*b* and 232*c* (collectively referred to as dies 232) and sensing devices 234*a* and 234*b* (collectively refer to as devices 234). System 210 additionally includes interconnect lines 36 (shown in FIG. 1).

Probe 230 comprises an elongated tubular member configured to support dies 232, devices 234 and lines 36 (shown in FIG. 1). In the particular example illustrated, probe 230 includes an exterior 240 configured to support dies 232, devices 234 and lines 36. Because probe 230 supports dies 232, devices 234 and lines 236 on exterior 240, probe 230 may be fabricated at a lower cost. In addition, repair or replacement of such components may be more easily completed and modification of probe 230 to meet varying needs is facilitated.

In the particular example illustrated, exterior 240 includes a plurality of the facets 242*a*, 242*b*, 242*c*, 242*d* and 242*e* (collectively referred to as facets 242). Facets 242 comprise generally flat, planar portions along exterior 240 upon which dies 232 and devices 234 may be mounted. Facets 242 facilitate reliable positioning of dies 232 and devices 234 at desired orientations with respect to axial centerline 246 of probe 230. In the example embodiment illustrated, facet 242*a* extends generally perpendicular to axial centerline 246 so as to face in a direction parallel to axial centerline 246. Facets 242*b*, 242*c* and 242*d* extend substantially parallel to axial centerline 246 so as to radially face away from axial centerline 246. Facet 242*e* is angled with respect to axial centerline 246 so as to face in a direction oblique to axial centerline 246. In the example illustrated, facets 42*d* and 42*e* extend in non-parallel planes proximate an end or tip of probe 230. In the example illustrated, facet 242*e* is angled at less than 90 degrees with respect to axial centerline 246. In the example illustrated, facet 242*e* extends in a plane at 82 degrees with respect to the probe axis 246, or 8 degrees away from the radial direction. In other embodiments, facet 242*e* may extend at an angle of 45 degrees with respect to axial centerline 246. In other embodiments, facet 242*e* may extend at other oblique angles with respect to axial centerline 246 depending on the shape of the object to be coated. In other embodiments, probe 230 may omit facets 242, wherein dies 232 and devices 234 are mounted to portions of exterior 240 which are not flat or planar. In yet other embodiments, dies 232 and devices 234 may alternatively be molded within or connected to probe 230 so as not to be located upon exterior 240.

Inkjet printhead dies 232 comprise packages of components arranged to form a mountable printhead including a plurality of individual and selectively actuatable fluid ejectors which eject fluid through a plurality of nozzles. According to one embodiment, printhead dies 232 comprise thermal resistive inkjet print heads in which heat produced by transmitting electrical current through resistors vaporizes fluid in a chamber behind a nozzle to expel remaining fluid through the nozzle. As a result, the print heads of dies 232 have greater spatial efficiency, allowing smaller geometries, and have a reduced sensitivity to gas bubbles in the system as compared to other drop-on-demand ejection devices such as piezo and acoustic ejection devices. In other embodiments, dies 232 may alternatively include other drop-on-demand ejection devices such as piezo and acoustic devices.

As shown by FIG. 7, die 232*a* is mounted to exterior 240 along facet 242*a* and faces in a direction substantially parallel to axial centerline 246. Die 232*b* is mounted to exterior 240 along facets 242*b* to face in a direction approximately perpendicular to axial centerline 246 radially outward from axial centerline 246. Die 232*e* is mounted to exterior 240 along facet 242*e* so as to face in directions oblique to axial centerline 246. Because die 232*e* faces in a direction oblique to axial centerline 246, die 232*e* facilitates the deposition of fluid upon surfaces that are also oblique to axial centerline 246, such as interior corners. As a result, it may more effectively dispense fluid to a wider range of interior surfaces.

Sensing devices 234 comprise devices configured to sense or detect interior surfaces of the structures, such a structure 112 (shown in FIG. 5), to facilitate viewing of the interior of structure 112 and to also provide feedback regarding the application of fluids to interior surfaces of structure 112. Sensing devices 134 provide signals to controller 24 (shown in FIG. 1), enabling controller 24 to provide visual images of the interior of structure 112 as well as areas upon which fluids have been deposited with display 22 (shown in FIG. 1). In one embodiment, sensing devices 234 further provide or project electromagnetic radiation, such as visible light, towards the interior surfaces of structure 112 to enhance viewing of the interior of structure 112. In the embodiment illustrated, sensing devices 234*a* and 234*b* comprises independent cameras including one of a charge-coupled device (CCD) sensor, a complementary metal oxide semiconductor (CMOS) sensor, or a contact image sensor (CIS). In other embodiments sensing devices 234 may comprise other devices. For example, sensing devices 234 may also comprise infra red or ultraviolet emitting and detecting sensing devices or MEMS contact cantilevers (profilometers) In other embodiments, sensing devices 234 may be omitted.

In the particular example illustrated, sensing devices 234 are mounted to exterior 240 of probe 230. As a result, devices 234 may be more easily assemble and fabricated as part of probe 230. Moreover, devices 234 may be more easily removed for repair or replacement or maybe more easily selectively added to better meet varying needs of an application. In the example ilustrated, sensing devices 234*a* and 234*b* are both mounted upon facet 242*d*. Sensing device 234*a* facilitates viewing in an axial direction while sensing device 234*b* facilitates viewing in a radial direction. In other embodiments, sensing device at 224 may be mounted upon other facets and may be mounted upon distinct facets from one another.

In operation, fluid dispenser 216 is inserted into interior 60 of structure 12 (shown in FIG. 1). In one embodiment, fluid dispenser 216 may be precisely positioned within interior 60 using visual feedback provided sensing devices 234 and display 22 (shown in FIG. 1). Controller 24 receives commands as to what portions of the interior surface of 62 of structure 12 are to be coated with fluid from fluid supply 18. Based upon such instructions, controller 24 generates control signals directing fluid supply 18 to supply one or more different fluids to dies 232 via lumens within probe 230. Controller 24 further generates control signals directing dies 232 to selectively eject the fluid onto interior surfaces 62 of structure 12. Controller 24 generates control signals also directing sensing devices 234 to detect the application of fluid to surfaces 62 and to transmit feedback signals to controller 24. Based on such feedback signals from sensing devices 234, controller 24 generates additional control signals directing display 22 (shown in FIG. 1) to present a visual image to a user, allowing the user to visually ascertain what portions of interior surface 62 of structure 12 are being coated, to determine whether positioning of fluid dispenser 16 needs to be adjusted, to determine whether the fluid injection pattern of dies 232 needs to be adjusted or to determine whether system 210 is operating properly.

In particular instances, controller 24 may generate control signals directing one or more fluids to be ejected and coated upon interior surface 62 of structure 12. In particular, controller 24 may generate control signals directing die 232*a* to eject a fluid in an axial direction. Controller 24 may generate control signals directing dies 232*b* to eject a fluid in a radial towards and onto a side or circumferential interior surface. Controller 24 may also generate control signals further directing die 32*e* to eject a fluid at an angle oblique to axial centerline 246 onto and into corners 76 of structure 12. As a result, system 210 is capable of coating substantially all interior surfaces 62 of structure 12 (shown in FIG. 1).

At the same time, positioning of fluid dispenser 216 and the placement of ejected fluid has increased accuracy as a result of sensing devices 234. The ejection of fluid onto structure 112 by die 232*a* may be reviewed using sensing device 234*a*. The ejection of fluid from die 232*b* may be reviewed or verified by sensing device 234*b*. Likewise, the ejection of fluid by die 232*e* onto surfaces of corners 76 (shown in FIG. 1) may be reviewed through the use of sensing devices 234*a*. In the particular example illustrated in which interior surface 162 is discontinuous so as to have one or more transverse, side or outwardly extending passages, voids, cavities or openings 190, 191 and the like which generally extend in a direction non-parallel to a centerline of structure 112 and non-parallel to the axis of dispenser 216 when dispenser 216 is inserted into interior 160, fluid dispenser 216 is well-suited for accurately depositing or coating fluid onto those portions of interior surface 162 that lie between or adjacent to such openings 190, 191. As a result, less fluid may be undesirably deposited within such openings 190, 191 or onto surfaces outside or beyond structure 112 through such openings 190, 191. For example, fluid dispenser 216 maybe especially suited for depositing fluid, such as one or more medicaments, upon interior surfaces of a stent with at least a reduced amount of fluid passing through sidewalls of the stent.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in the other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a tubular member having a closed off tip;

a plurality of inkjet print head dies directly seated upon an exterior outer circumferential surface of the tubular member while concurrently facing in different fixed directions relative to one another, the plurality of inkjet print head dies having adjustable fluid ejection patterns, each of the plurality of inkjet print head dies comprising a flat planar package of components, the package comprising ejectors, a first face seated upon the exterior outer circumferential surface of the tubular member, and a second face which is flat and opposite to the first face, and a plurality of nozzles for directing liquid propelled by the electors, said plurality of nozzles are located along said second face and extend through said second face;

a plurality of lumens within the tubular member, each lumen configured to supply fluid to one of the inkjet print head dies; and wherein the tubular member includes a plurality of facets, each facet comprising a planar surface formed on the outer exterior circumferential surface of the tubular member and supporting one of the plurality of inkjet print head dies.

2. The apparatus of claim 1, wherein the inkjet print head dies include a first die facing in a first direction oblique to an axial centerline of the tubular member for ejecting fluid in the first direction.

3. The apparatus of claim 2, wherein the inkjet printhead dies include a second die facing in a direction parallel to the axial centerline.

4. The apparatus of claim 3, wherein the inkjet print head dies include a third die facing in a direction perpendicular to the axial centerline.

5. The apparatus of claim 2 wherein the inkjet print head dies include a second die facing in a second direction oblique to an axial centerline of the tubular member for ejecting fluid in a second direction, wherein the first direction in which the first die faces and the second direction in which the second die faces are divergent and non-intersecting.

6. The apparatus of claim 5, wherein the first printhead die is at a forward tip of the tubular member and extends in a first plane and wherein the second print head die is at the tip of the tubular member and extends in a second plane non-parallel to the first plane, wherein the first plane and the second plane face in forward divergent, non-intersecting directions.

7. The apparatus of claim 1 further comprising a first sensing device mounted to an exterior of the tubular member.

8. The apparatus of claim 7, wherein the first sensing device has a first sensing range having a centerline oblique to an axial centerline of the tubular member.

9. The apparatus of claim 8, wherein the inkjet print head dies include a first die facing in a direction parallel to the centerline of the first field of vision.

10. The apparatus of claim 8 further comprising a second sensing device mounted to the exterior of the tubular member and having a second sensing range having a centerline parallel to the axial centerline of the tubular member.

11. The apparatus of claim 10, wherein the inkjet print head dies include a first die facing in a first direction parallel to the centerline of the first sensing range and a second die facing in a second direction parallel to the centerline of the second sensing range.

12. The apparatus of claim 10 further comprising a third sensing device mounted to the exterior of the tubular member and having a third sensing range having a centerline perpendicular to the axial centerline of the tubular member.

13. The apparatus of claim 12 wherein the inkjet print head dies include a first die facing in a first direction parallel to the centerline of the first sensing device, a second die facing in a direction parallel to the centerline of the second sensing device and a third die facing in a direction parallel to the centerline of the third sensing device.

14. The apparatus of claim 1, wherein the inkjet print head dies include a plurality of thermoresistive inkjet printhead dies.

15. The apparatus of claim 1 further comprising a signal transmitting circuit extending along an exterior of the tubular member and electrically connected to the inkjet print head dies.

16. The apparatus of claim 1, wherein the inkjet print head dies comprise a first inkjet printhead die facing in a direction oblique to an axial centerline of the tubular member and a second inkjet printhead die facing perpendicular to an axial centerline of the tubular member, wherein the plurality of lumens includes a first lumen configured to supply fluid to the first inkjet printhead die and a second lumen configured to supply fluid to the second inkjet printhead die.

17. The apparatus of claim 1, wherein the tubular member has an outer wall and internal walls integral with the outer wall to partition an interior of the tube into multiple lumens to supply fluid to the inkjet print head dies, the outer wall having an inner surface that contacts fluids flowing through the multiple lumens and an outer surface upon which the inkjet print head dies are directly seated.

18. The apparatus of claim 17, wherein the outer wall and the internal walls integral with the outer wall partition the interior of the tube into a central lumen centered about a center axis of the tube and a plurality of outer lumens circumscribing the central lumen.

19. An apparatus comprising:

a fluid delivering probe extending along an axis, the fluid delivering probe comprising a multi-lumen tube having an outer wall and internal walls integral with the outer wall to partition an interior of the tube into multiple lumens for independently delivering fluids, the outer wall having an inner surface that contacts fluids flowing through the multiple lumens and an outer surface; and inkjet print head dies mounted on an exterior of the probe, each of the inkjet print head dies comprising a flat planar package of components, the package comprising ejectors, a first face seated upon the exterior of the probe, a second flat face which is flat and opposite to the first face, and a plurality of nozzles for directing liquid propelled by the ejectors, said plurality of nozzles are located along a said second face and extend through said second face, wherein each package is fixed against movement and directly supported upon the outer surface of the outer wall and connected to the multiple lumens, one of the inkjet print head dies facing in a direction oblique to the axis.

20. An apparatus comprising:

a tubular member; and at least one inkjet print head die mounted to an exterior of the tubular member, wherein the at least one inkjet print head die comprises:

a first die facing in a first direction oblique to an axial centerline of the tubular member, the first die for electing fluid in the first direction; and a second die facing in a second direction divergent with respect to the first direction and oblique to the axial centerline of the tubular member, the second die for electing fluid in the second direction, each of the first die and the second die comprising a flat planar package of components, the package comprising ejectors, a first face seated upon the exterior of the tubular member, a second face which is flat and opposite to the first face, and a plurality of nozzles for directing liquid propelled by the electors, said plurality of nozzles are located along said second face and extend through said second face, wherein the tubular member includes a plurality of facets, each facet comprising a planar surface formed on the exterior of the tubular member and supporting the at least one inkjet print head die.

21. The apparatus of claim 20, wherein the at least one inkjet print head die includes a third die facing in a direction parallel to the axial centerline.

22. The apparatus of claim 21, wherein the at least one inkjet print head die includes a fourth die facing in a direction perpendicular to the axial centerline.

23. The apparatus of claim 20, wherein the first print head die is at a forward tip of the tubular member and extends in a first plane and wherein the second print head die is at the tip of the tubular member and extends in a second plane non-parallel to the first plane, wherein the first plane and the second plane face in forward divergent directions.

24. The apparatus of claim 20, wherein the tubular member comprises an outer wall and internal walls integral with the outer wall to partition an interior of the tube into multiple lumens for independently delivering fluids, the outer wall having an inner surface that contacts fluids flowing through the multiple lumens and an outer surface and wherein the first die and the second die are fixed against movement with respect to and directly supported upon the outer surface of the outer wall, the first die and the second die being connected to the multiple lumens.

* * * * *

UNITED STATES PATENT AND TRADEMARK OFFICE

CERTIFICATE OF CORRECTION

PATENT NO. : 8,733,274 B2
APPLICATION NO. : 11/551318
DATED : May 27, 2014
INVENTOR(S) : David R. Otis, Jr. et al.

It is certified that error appears in the above-identified patent and that said Letters Patent is hereby corrected as shown below:

In the claims

In column 11, line 47, in Claim 1, delete "electors," and insert -- ejectors, --, therefor.

In column 13, line 28, in Claim 20, delete "electing" and insert -- ejecting --, therefor.

In column 13, line 32, in Claim 20, delete "electing" and insert -- ejecting --, therefor.

In column 14, line 4, in Claim 20, delete "electors," and insert -- ejectors, --, therefor.

Signed and Sealed this
Tenth Day of November, 2015

Michelle K. Lee

Michelle K. Lee
*Director of the United States Patent and Trademark Office*